United States Patent [19]

LaCount, II et al.

[11] Patent Number: 4,882,913

[45] Date of Patent: Nov. 28, 1989

[54] SLIDE PLATE ECONOMIZER

[75] Inventors: Nelon N. LaCount, II, Syracuse; Dilip Y. Vyavaharkar, Liverpool; Rudy Bussjager, Chittenango, all of N.Y.

[73] Assignee: Carrier Corporation, Syracuse, N.Y.

[21] Appl. No.: 260,228

[22] Filed: Oct. 20, 1988

[51] Int. Cl.[4] ..... F25D 17/04; G05D 23/13

[52] U.S. Cl. ..... 62/409; 98/34.6; 137/625.4; 137/625.48; 165/16; 236/13; 251/266

[58] Field of Search ..... 62/409, 410; 236/13; 165/16; 251/266, 267; 137/625.4, 625.48; 98/34.5, 34.6

[56] References Cited

U.S. PATENT DOCUMENTS

| | | | |
|---|---|---|---|
| 2,828,110 | 3/1958 | Baker et al. | 236/13 X |
| 3,286,479 | 11/1966 | Nolan et al. | 62/186 |
| 3,299,796 | 1/1967 | Toper et al. | 98/36 |
| 4,281,522 | 8/1981 | Bussjager | 62/409 |
| 4,478,056 | 10/1984 | Michaels, Jr. | 62/332 |
| 4,495,986 | 1/1985 | Clark et al. | 165/2 |
| 4,519,539 | 5/1985 | Bussjager et al. | 236/13 |
| 4,757,744 | 7/1988 | Bouvot | 137/625.48 X |
| 4,759,196 | 7/1988 | Davis | 98/34.6 X |

FOREIGN PATENT DOCUMENTS

| | | | |
|---|---|---|---|
| 718740 | 11/1954 | United Kingdom | 98/34.5 |

*Primary Examiner*—William E. Tapolcai

*Attorney, Agent, or Firm*—Dana F. Bigelow

[57] ABSTRACT

An economizer has a single sliding door which leads to the indoor section from both the outdoor air inlet and the return air inlet, with the two inlets being separated by a divider baffle. The sliding plate is movable from its fully closed position, wherein the indoor section is shut off from the outdoor air inlet, to a fully opened position, wherein all of the air passing to the indoor section is coming from the outdoor air inlet and the opening between the indoor section and the return air inlet is closed. The sliding plate can also be placed in intermediate positions wherein a mixture of return air and outdoor air is provided to the indoor section. The economizer is so designed that it may be applied to either a down discharge or a side discharge unit without any change to the economizer structure itself. The sliding plate is moved by way of a threaded shaft which is rotated by a motor, and various switches are provided to detect positional and directional conditions of the sliding plate in order to facilitate control thereof.

24 Claims, 5 Drawing Sheets

SLIDE PLATE ECONOMIZER

BACKGROUND OF THE INVENTION

This invention relates generally to air conditioning systems and, more particularly, to an economizer sliding door mechanism for selectively opening the respective return air and outdoor air inlet openings thereof.

A packaged rooftop air conditioning unit typically includes indoor and outdoor sections, with the indoor section having a fan for drawing the air from the enclosure by way of a return air duct and causing it to be passed over the evaporator coil to be cooled, after which it is recirculated back to the enclosure. In order to take advantage of the cooler outdoor air during low temperature ambient conditions, an economizer is provided to draw the cooler outdoor air into the evaporator. Thus, the air passing through the evaporator may be a mixture of return air and outdoor air, with the respective quantities of each being controlled by way of a damper system.

One such economizer assembly is shown in U.S. Pat. No. 4,478,056 issued on Oct. 23 1984 and assigned to the assignee of the selectively vary the openings for the admission of outdoor air, but little, if any, control is provided for varying the opening for admission of the return air flow to the evaporator. Further, the sliding movement and positive positioning control of the door is difficult to maintain with the pivoting drive rod arrangement as provided. Another disadvantage of that system which is shown in a down discharge (i.e. return air flowing upwardly from the bottom) system, is that it is not easily adaptable to a side discharge system. That is, it would be necessary to have a different economizer for use in a side discharge system, thereby increasing the inventory requirements and complicating the assembly process.

It is therefore an object of the present invention to provide a rooftop air conditioner with an improved economizer structure.

Another object of the present invention is the provision for an economizer structure which can be selectively controlled to vary the air flow to the evaporator, both from the outdoor air inlet and the return air inlet.

Yet another object of the present invention is the provision for an improved drive mechanism for the sliding door of an economizer apparatus.

Still another object of the present invention is the provision in a rooftop air conditioning unit for an economizer which can be installed in either a down-discharge or a side-discharge unit.

Yet another object of the present invention is the provision for a rooftop air conditioner economizer structure which is economical to manufacture and effective in use.

These objects and other features and advantages become more readily apparent upon reference to the following description when taken in conjunction with the appended drawings.

SUMMARY OF THE INVENTION

Briefly, in accordance with one aspect of the invention, an economizer is provided to fluidly interconnect both the return air duct and the outdoor air inlet to the indoor section of the air conditioner, with the amount of air coming from each being controlled by a single plate. A divider baffle is provided between the return air inlet structure portion of the economizer and the outdoor inlet structure portion thereof.

By another aspect of the invention, the economizer structure includes a return air inlet side, an outdoor air inlet side disposed substantially normally thereto, and a divider baffle which extends from the intersection of those sides to a third side which, on one side of said baffle, defines the return air discharge opening and on the other side thereof defines the outdoor air discharge opening. A sliding plate is mounted on the third wall in such a way as to be slideably adjustable between one extreme position wherein the return air discharge opening is fully open and the outdoor air discharge opening is fully closed, and a second extreme position wherein the outdoor air discharge opening is fully open and the return air discharge opening is fully closed. The economizer structure can be placed in the air conditioning system with its return air inlet opening in a downward position so as to be useful in a down discharge unit, or it may be placed with its return air inlet opening in the side of the unit to thereby function in a side discharge unit.

By yet another aspect of the invention, the sliding plate of the economizer is actuated by way of a rotatable threaded shaft which engages a threaded strut mounted on the plate. As the shaft is rotated by an attached motor, the threaded strut is caused to move upwardly or downwardly on the shaft to selective positions between the two extremes. Limit switches are provided to sense the position and direction of movement of the plate and to otherwise facilitate the control thereof.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
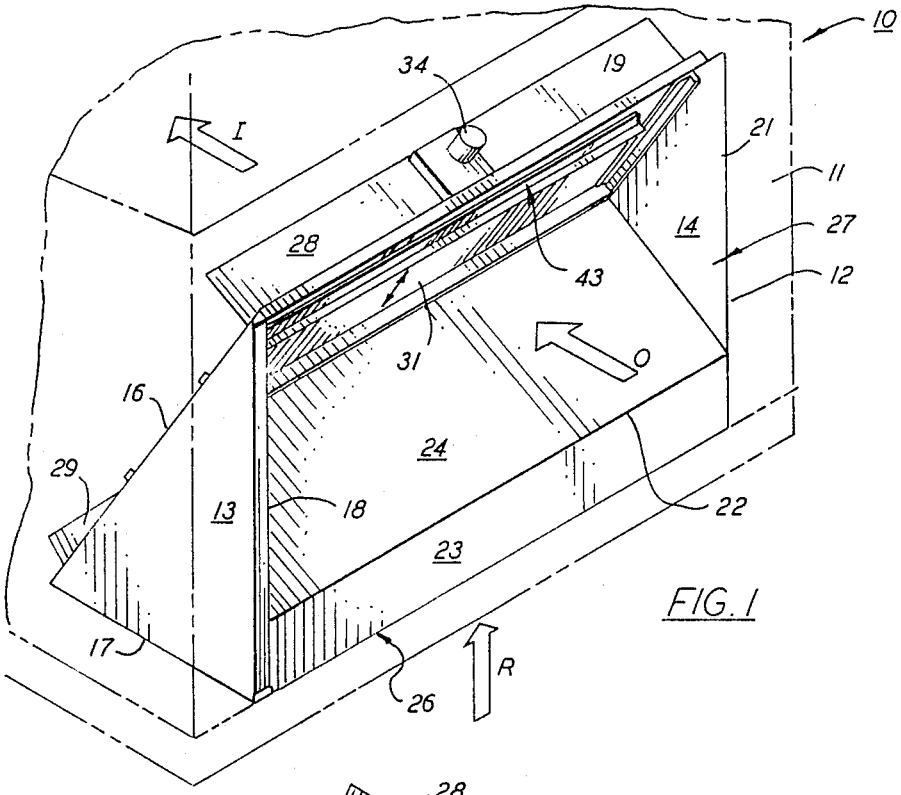
FIG. 1 is a perspective view of an economizer in accordance with the present invention.

Referring now to FIG. 1, the invention is shown generally at 10 as installed in the indoor portion 11 of a rooftop air conditioner. A three sided economizer structure 12 is installed in the indoor portion 11 in such a manner that outdoor air is permitted to enter in the direction indicated by the arrow 0, and indoor or return air is allowed to enter in the direction indicated by the arrow R, such that the economizer structure 12 provides a mixture to the indoor coil (not shown), with the direction of flow being indicated by the arrow I.

The economizer structure 12 is comprised of triangular shaped end plates 13 and 14, with end plate 13 having sides 16, 17, and 18, and end plate 14 having sides 19, 20, and 21. Rigidly mounted between the end plates 13 and 14 is a baffle structure 22 having a vertical portion 23 extending between portions of the end wall sides 12 and 18, and a slanted portion 24 which extends from the top of the vertical portion 23 to a plane defined by the end plate sides 16 and 19. This baffle structure 22 forms a common boundary between the return air flowing into the opening 26 in the direction indicated by the arrow R, and the outdoor air flowing through the opening 27 in the direction indicated by the arrow 0.

In addition to being interconnected by the baffle structure 22, the two end plates 13 and 14 are interconnected by a top member 28 and bottom member 29. Slideably mounted between the top and 1 bottom members 28 and 29, respectively, is a door or plate 31 with its sides slideably engaged in a track 25 mounted on the respective sides 16 and 19 of the end plates 13 and 14, and with upper and lower edges 30 and 35, respectively. The mechanism for sliding the plate 31 in the track 25 includes a strut 32 which is attached to the sliding plate 31 and extends substantially normally therefrom, a threaded shaft 33 which is threadably engaged with an opening in the strut 32, and a drive motor 34 which operates to rotate the shaft 33 so as to move the sliding plate 31 up or down. The strut 32 and associated shaft 33 is preferably composed of a wear resistant material such as Delrin, brass, or the like.

To assist in the control of the plate movement, upper and lower limit switches 37 and 38, and upper and lower positional/ directional switches 39 and 41 are provided. A plug 42 is provided to interconnect the motor 34 and the above mentioned switches to the electronic control device (not shown).

Figure 2:
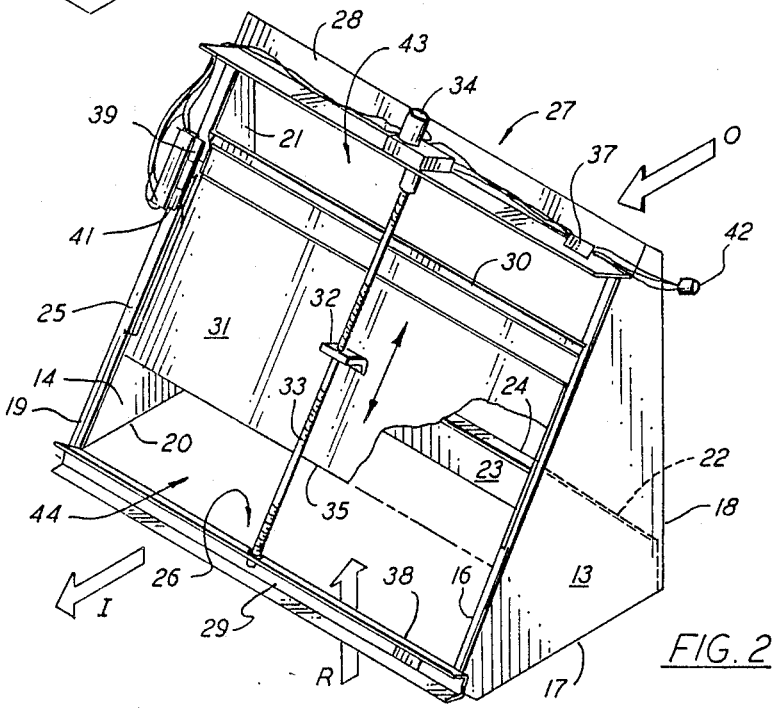
FIG. 2 is a perspective rear view thereof.

As shown in FIGS. 1 and 2, the sliding plate 31 is in the "minimum outdoor air" position wherein the plate upper edge 30 is separated from the top member 28 to define an opening 43 through which a minimal amount of outdoor air is allowed to enter the indoor section of the system. In this position, the plate lower edge 35 is somewhat below the upper edge of the baffle structure slanted portion 24 such the opening 44 defined by the plate lower edge 35 and the bottom member 29 is almost fully open but is somewhat restricted to the full flow of return air, and allows the inflow of the minimal amount of outdoor air as required during operation. When the economizer is not in operation, the sliding plate 31 goes to the fully closed position (i.e. with the sliding plate upper edge 30 abutting the upper member 28, such that the return air opening 44 is completely open and the outdoor air opening 43 is completely closed).

Figure 3:
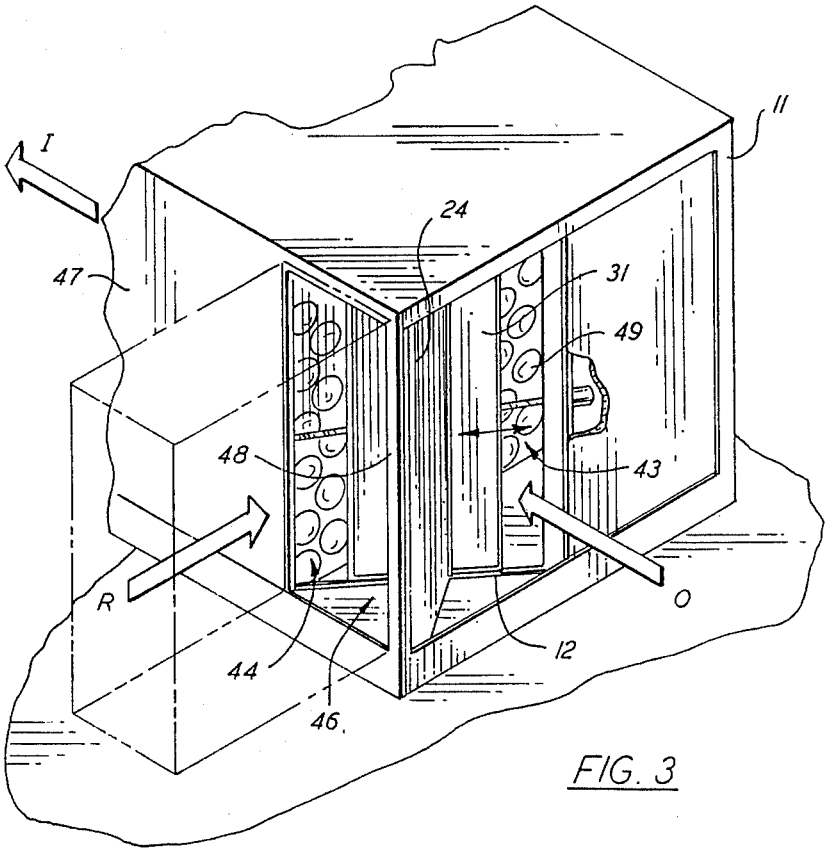
FIG. 3 is a perspective view thereof as installed in a system of the side discharge type.

While the economizer structure 12 is shown in FIG. 1 to be installed in a downflow unit (i.e. with the return air flowing upwardly as shown and with the subsequently cooled air then flowing downwardly), the design of the present invention permits the installation of the identical economizer structure in a side discharge unit (i.e. with the return air flowing in from the side and the subsequently cooled air being discharged from the side of the unit). Such an installation is shown in FIG. 3. As will be seen, an opening 46 is provided in the side 47 of the indoor section 11 to allow for the return air to flow inwardly from the side. The economizer structure 12 is installed in much the same way as the downflow unit except that it is rotated 90° clockwise, as seen from the outdoor air side of the unit. In this position, the baffle slanted portion 24 extends inwardly from the vertical edge 48, and the sliding door 31 moves in the directed indicated by the arrows. An air filter 49 is shown in its installed position such that it functions to filter the air entering the outdoor air opening 43 and the return air opening 44.

Figure 4:
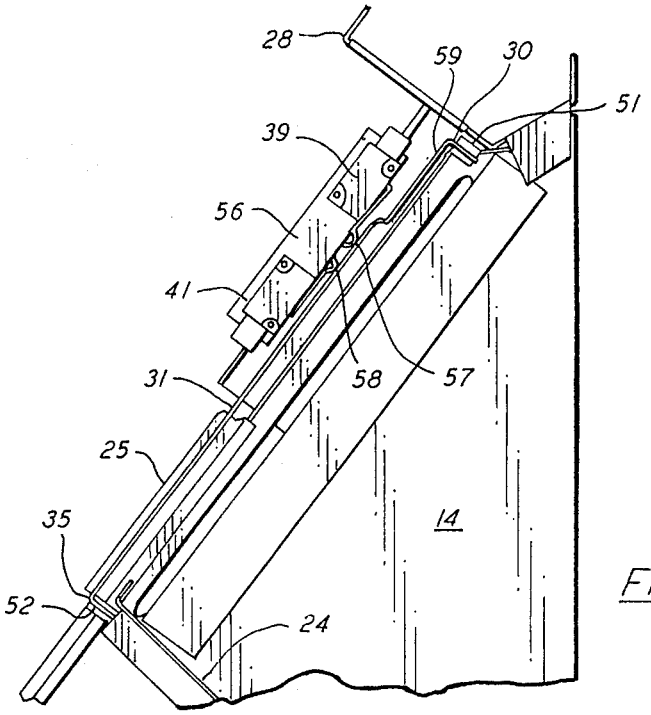
FIG. 4 is a partial side view thereof with the plate in the fully closed position.
Figure 6:
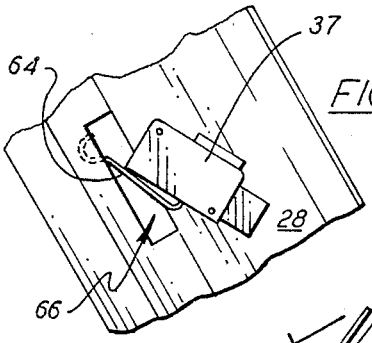
FIG. 6 is a partial view as seen along lines 6—6 of FIG. 5.

Referring now to FIG. 4, the sliding plate 31 is shown in its closed position between the baffle structure slanted portion 24 and the top member 28. Upper and lower damper seals 51 and 52, respectively, are provided to maintain sealing relationships between the respective upper 30 and lower 35 edges of the plate 31 and the respective top member 28 and the baffle slanted portion 24. These damper seals are composed of a deformable material such as rubber or the like and are simply installed by fitting them over the top and bottom edges of the sliding plate as indicated. At the side edges of the plate, the tracks 31, a portion of which is shown at 25, interface between the side edges of the sliding plate 31 and the edges 16 and 19 of the respective end plates 13 and 14 in a manner to be discussed hereinafter with respect to FIG. 10.

The switches 39 and 41 are attached to the end plate 14 by way of a bracket 56. As will be seen, the switches 39 and 41 have spring loaded contacts 57 and 58, respectively, which operate to activate the switches when they are depressed in a direction toward the bracket 56. As shown, the contacts 57 and 58 are both depressed such that the switches 39 and 41 are both closed. The contacts 57 and 58 are depressed by way of direct contact with the plate 31 and are allowed to spring to an unloaded or off position when the slide plate 31 is moved to a position wherein engagement is no longer maintained with the contacts 57 and/or 58. For that purpose, the slide plate 31 has an offset portion 59 at its upper end thereof. When either of the contacts 57 or 58 are engaging the offset portion 59, the associated switch 39 or 41 is open. The particular position of the respective switches 39 and 41, together with the sequence of operations, is used to coordinate the control aspects of moving the slide plate 31. For example, since the motor 34 is preferably, for the sake of cost, a DC motor, its direction of rotation will vary in a somewhat random manner from one operation to the next. The switches 39 and 41 function to determine what direction the slide plate 31 is moving and, if it is moving in the wrong direction, cause the direction of the motor to be reversed. To illustrate, assume that the slide plate 31 is in the minimal outdoor air position wherein the contact 57 is just at the beginning of the offset portion 59 once the switch 39 is open. If the drive motor 34 is then turned on to move the slide plate toward the closed position then the contact 57 should immediately ride up to the non-offset portion to thereby close the switch 39. If, in fact, the motor commences to rotate in the opposite direction to thereby move the slide plate 31 downwardly, then the contact 57 will continue to remain in the offset portion 59 and the switch 39 will remain open, and the contact 58 will enter the offset portion 59 to open the switch 41, thus telling the control that the direction of the motor 34 is incorrect and must be reversed.

Figure 5:
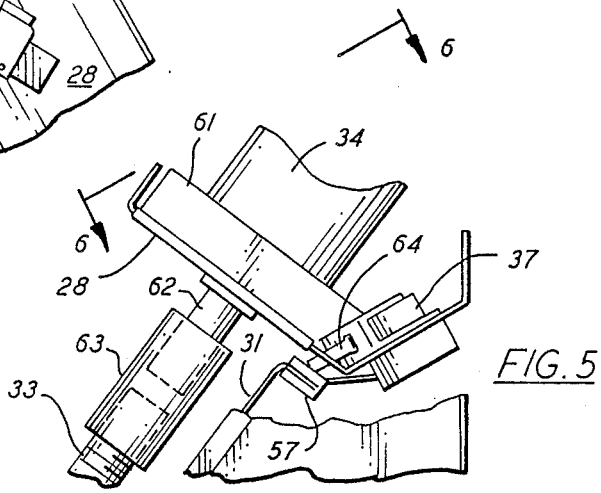
FIG. 5 is an enlarged partial view of the upper portion thereof.

Referring now to FIG. 5, the motor 34 is shown as being drivingly connected to the shaft 33 by way of a gear box 61, a drive shaft 62, and a coupling 63 The slide plate 31 is shown in its closed position with its damper seal 51 engaging a spring loaded contact 64 of the limit switch 37. The contact 64 extends through an opening 66 in the top member 28. Thus, when the slide plate 31 is in the closed position, the contact 64 is depressed to close the switch 37 and let the control system know that the slide plate 31 is in fact in the closed position. When it is moved away from the closed position, the contact 64 springs to its undepressed position and the switch 37 is opened to thereby inform the control system of that fact.

Figure 7:
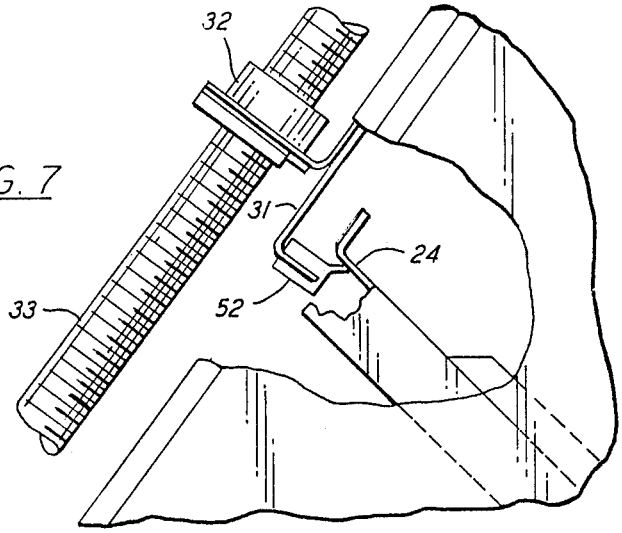
FIG. 7 is an enlarged partial view of the middle portion thereof.
Figure 9:
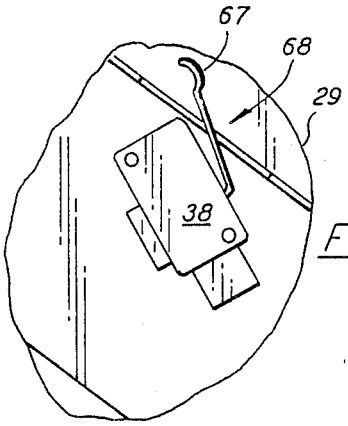
FIG. 9 is a view thereof as seen along lines 9—9 of FIG. 8.
Figure 8:
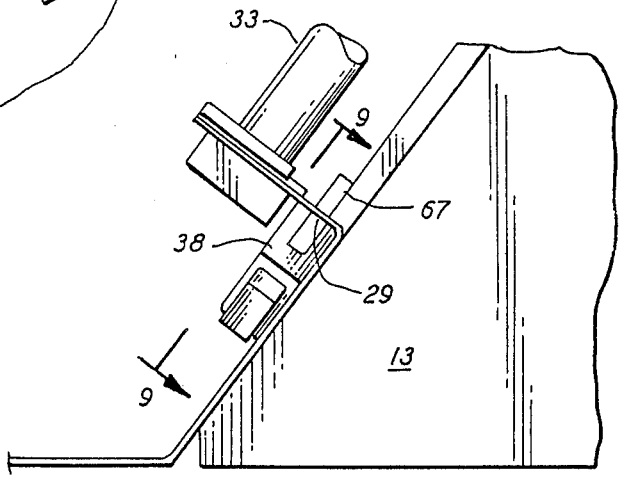
FIG. 8 is an enlarged partial view of the bottom portion thereof.

Referring to FIG. 7, it will be seen that at the other end of the sliding plate 31, the bottom damper seal 52 engages the baffle slanted portion 24 to thereby seal the indoor section of the unit from entry of air from outdoors. As the sliding plate 31 is moved to the open position, the damper seal 52 no longer functions as a seal and, until it reaches the lower limit, it performs no function at all. When it reaches its lowermost point (i.e. the fully opened position), it engages the bottom member 29 and at that point the damper seal 52 functions to dampen the impact of the engagement. When the sliding plate 31 is moved to that fully open position, the limit switch 38 functions to sense that condition and to communicate that fact to the control system. As shown in FIG. 8 and 9, the limit switch 38 has a spring loaded contact 67 that extends through an opening 68 in the bottom member 29. Normally the contact 67 is in the undepressed position and the switch 38 is in the open condition. When the sliding plate 31 moves to its fully open position the bottom damper seal 52 functions to engage the contact 67 and cause it to be depressed and to thereby close the switch 38.

Figure 10:
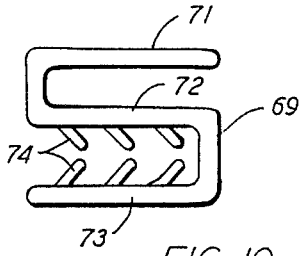
FIG. 10 is a plan view of a track member portion thereof.

As mentioned hereinabove, the sliding plate 31 engages the side edges by way of a track 54. The track 54 comprises a pair of interlocked, S-shaped members, one of which is shown in FIG. 10. The member 69, which is formed of a wear resistant material such as Delrin, has parallel legs 71, 72, and 73. Between the legs 72 and 73 there is a plurality of extensions 74 that are inwardly biased such that a flange member can be inserted therein in such a way that the extension 74 will then hold that member in the installed position. For example, a flange extending inwardly from the edge 19 of the end plate 14 fits into the space between the extensions 74. The other leg ther S-shaped member 69 having the side edge of the sliding plate 31 inserted in the corresponding space between the extensions 74. The two interlocked S-shaped members 69 are thus each secured to their respective members (i.e. the end plate flange and the edge of the sliding plate), and a sliding relationship is maintained between the two interlinked legs 71 of the two members.

Figure 11:
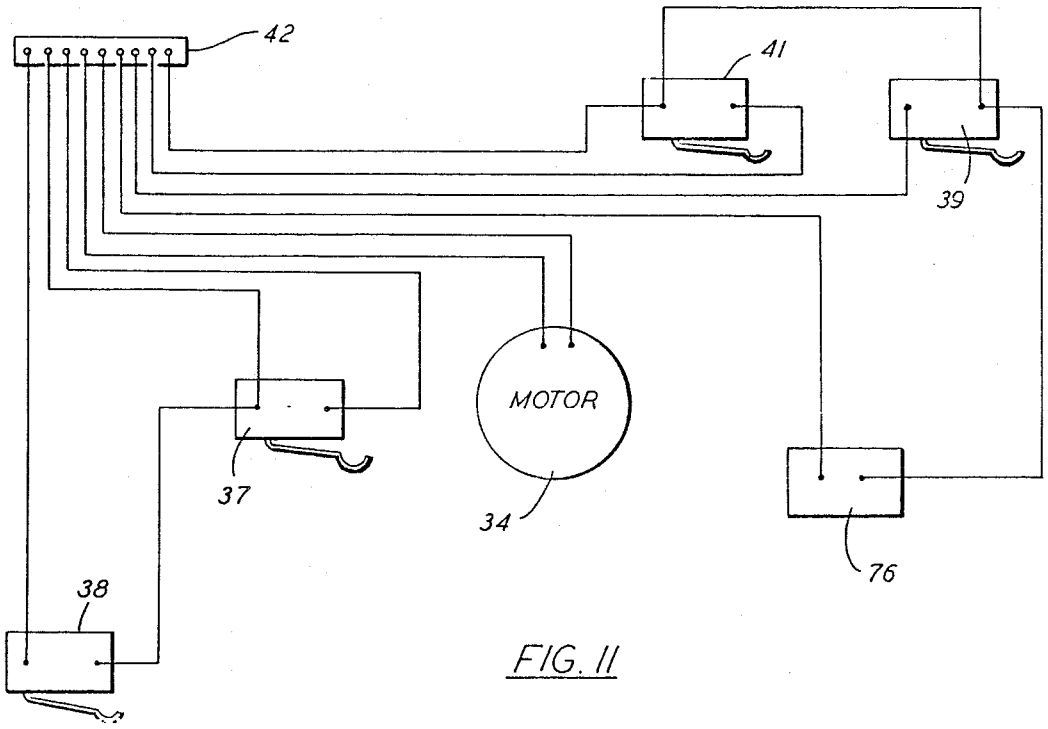
FIG. 11 is a schematic illustration of the electrical control portion thereof.

Referring now to FIG. 11, the electrical wiring for each of the switches is shown. As mentioned hereinabove, the plug 42 is electrically connected to a control device (not shown) which functions to operate the motor 34 in response to sensed positions of the two limit switches 37 and 38, and of the positional/directional switches 39 and 41, and from a signal received from the outdoor air thermostat 76.

Having described the structure of the present invention, the sequence of operation will now be described. For purposes of discussion, let us first assume that the outdoor air temperature is above the setting of the outdoor air thermostat. If the room thermostat calls for cooling, heating, or continuous fan, the sliding plate 31 is moved to a "minimum outdoor air" position and remains there until the thermostat is satisfied (or, in the case of continuous fan operation, as long 1 as the indoor fan is energized), after which the sliding door 31 is moved to the fully closed position.

If the outdoor air temperature is below the setting of the outdoor air thermostat, the position of the sliding plate will be determined by the mode of operation and the various operating conditions. For example, if the room thermostat calls for cooling, the sliding plate will automatically move to the "minimum outdoor air" position. If the discharge air temperature is above a predetermined threshold such as, for example, 12° C., the sliding plate will continue to move toward the fully open position, in predetermined increments, so long as the discharge air temperature remains above 12° C. That is, the sliding plate will move to the next increment of openers and remain there for 30 seconds and, if the discharge air temperature is still above 12° C., it will move on to the next increment of openers. If the discharge air temperature remains above 10° C., the sliding plate will eventually move to the fully open position.

If the discharge air temperature falls between 12° C. and 10° C., the sliding plate will remain at an intermediate open position.

If the discharge air temperature falls below 10° C., the sliding plate will modulate back toward the "minimum outdoor air" position. In any of the above cases, when the thermostat is satisfied, the sliding plate will move back to the fully closed position.

If the room thermostat calls for heating or for continuous fan operation when the outdoor air temperature is below the setting of the outdoor air thermostat, the sliding plate will move to the minimum outdoor air position and remain there until the thermostat is satisfied (or until the indoor fan is energized), after which it will move to the fully closed position.

While the present invention has been disclosed with particular reference to a preferred embodiment, the concepts of this invention are readily adaptable to other embodiments, and those skilled in the art may vary the structure thereof without departing from the essential spirit of the present invention.

What is claimed is:

1. An improved economizer apparatus of the type installable in an air conditioning system for selectively providing fluid communication from the return air duct and/or outdoor air inlet to the indoor section of the air conditioning system comprising:

a return air inlet structure defined on three sides by a return air inlet opening for registering with the return air duct, a divider baffle, and a return air discharge opening for fluidly connecting said inlet structure to the indoor section;

an outdoor air inlet structure defined on three sides by said divider baffle, the outdoor air inlet opening, and an outdoor air discharge opening for fluidly connecting the outdoor air to the indoor section; and a plate attached to said return air inlet and outdoor air inlet structures and selectively positionable thereon to close selective portions of said return air discharge and outdoor air discharge openings, respectively.

2. An improved economizer apparatus as set forth in claim 1 wherein said plate is selectively positionable by sliding it on said return air inlet and outdoor inlet structures.

3. An improved economizer apparatus as set forth in claim 1 wherein said return air discharge opening and said outdoor air discharge opening are co-linear.

4. An improved economizer apparatus as set forth in claim 3 wherein said return air discharge opening and said outdoor air discharge opening are joined at a point where said divider baffle terminates.

5. An improved economizer apparatus as set forth in claim 1 wherein said plate is planar in form.

6. An improved economizer apparatus as set forth in claim 5 wherein the length of said plate is substantially equal to the length of said return air discharge opening, which in turn is substantially equal to said outdoor air discharge opening.

7. An improved economizer apparatus as set forth in claim 5 wherein said plate is selectively positionable by sliding it along a plane which is parallel with said return air discharge opening and outdoor air discharge opening.

8. An improved economizer apparatus as set forth in claim 7 wherein said plate is slideably positioned by a screw drive apparatus.

9. An improved economizer apparatus as set forth in claim 1 and including:

a threaded strut mounted on said plate; and a threaded shaft rotatably mounted on said return air inlet and said outdoor inlet structures and threadably engaged with said strut to thereby cause linear movement of said plate upon rotation of said shaft.

10. An improved economizer apparatus as set forth in claim 9 and including a motor drivingly connected to said shaft for rotation thereof.

11. In an air conditioning system of the type having an economizer for selectively providing respective outdoor air discharge and return air discharge openings through which outdoor air and/or return air can flow to an evaporator coil, an improved sliding door mechanism comprising:

a door slideably mounted on an economizer and being so positioned and sized that on one extreme position it covers the outdoor air discharge opening and uncovers the return air discharge opening and at its other extreme position it covers the return air discharge opening and uncovers the outdoor air discharge opening;

a threaded strut attached to said door and extending substantially normally therefrom;

a threaded shaft threadably engaging said threaded strut so as to cause linear movement thereof upon rotation of said shaft; and drive means to selectively rotate said threaded shaft so as to selectively position said door with respect to said return air discharge and outdoor air discharge openings, respectively.

12. An improved sliding door mechanism as set forth in claim 11 wherein said strut includes internal threads and said shaft includes external threads.

13. An improved sliding door mechanism as set forth in claim 11 wherein said strut and said shaft are comprised of the same type of material.

14. An improved sliding door mechanism as set forth in claim 11 and including a control mechanism for sensing various positions of said door.

15. An improved sliding door mechanism as set forth in claim 14 wherein said control mechanism includes a limit switch which is closed when said door is in the extreme position wherein it covers the outdoor air discharge opening.

16. An improved sliding door mechanism as set forth in claim 14 wherein said control mechanism includes a limit switch which is closed when said door reaches the extreme position wherein it covers the return air discharge opening.

17. An improved sliding door mechanism as set forth in claim 14 wherein said drive means comprises a DC motor and wherein said control mechanism includes means for sensing the direction of door movement.

18. An improved sliding door mechanism as set forth in claim 17 wherein said door has an offset portion formed therein, and further wherein said directional sensing means includes a limit switch for engaging said offset portion when the door is in a predetermined position.

19. In an air conditioning system of the type having a fan coil over which air is selectively drawn from a return air duct and/or an outside air duct, an improved economizer comprising:

a pair of end walls each having at least three sides, two of which are disposed in substantial normal relationship and partially defining outside air inlet and return air inlet openings, respectively, and a third of said at least three sides partially defining both an outside air discharge opening and a return air discharge opening, each of which communicates with the fan coil when in its open condition;

a divider baffle interconnected between said pair of end walls and extending from the intersection of said outside air inlet and said return air inlet openings to the intersection of said outside air discharge and said return air discharge openings; and a door mounted between said pair of end walls and being slideably positionable along said third side to thereby cover selective portions of said outside air discharge opening and said return air discharge opening.

20. An improved economizer as set forth in claim 19 wherein said economizer is adaptable for use in either an air conditioning unit having a return air duct interconnected at its bottom or one having a return air duct interconnected at its side, the former being accommodated by positioning said economizer such that said outside air inlet opening is disposed in a bottom wall of the furnace, and the latter being accommodated by positioning said economizer such that said return air inlet opening is disposed in a side wall thereof.

21. An improved economizer as set forth in claim 19 wherein said door is so sized and positioned that, when it moves in a direction to close one of said outside air discharge or return air discharge openings, it simultaneously opens the other thereof.

22. An improved economizer as set forth in claim 19 wherein said door is planar in form.

23. An improved economizer as set forth in claim 19 and including motor drive means for slideably positioning said door.

24. An improved economizer as set forth in claim 23 wherein said motor drive means includes a threaded strut mounted on said door and a rotatable shaft threadably engaging said strut such that when said shaft is rotated, said strut is moved along said shaft so as to cause sliding movement of said door.

* * * * *